US006270424B1

(12) United States Patent
Holub

(10) Patent No.: US 6,270,424 B1
(45) **Date of Patent: *Aug. 7, 2001**

(54) MULTI-PURPOSE GOLF ACCESSORY

(76) Inventor: Craig S. Holub, 16 Field St., Lively, Ontario (CA), P3Y 1A9

( * ) Notice: Subject to any disclaimer, the term of this patent is extended or adjusted under 35 U.S.C. 154(b) by 0 days.

This patent is subject to a terminal disclaimer.

(21) Appl. No.: 09/438,968

(22) Filed: Nov. 12, 1999

Related U.S. Application Data

(63) Continuation of application No. 09/116,990, filed on Jul. 17, 1998, now Pat. No. 5,997,411.

(30) Foreign Application Priority Data

Jul. 14, 1999 (CA) ..... 2277354

(51) Int. Cl.[7] ..... A63B 57/00

(52) U.S. Cl. ..... 473/286; 473/408; 150/160; 15/105

(58) Field of Search ..... 473/282–286, 473/408; 150/160; 206/315.4, 315.2; 211/70.2; 248/156; 15/105

(56) References Cited

U.S. PATENT DOCUMENTS

| | | | | |
|---|---|---|---|---|
| D. 395,480 | | 6/1998 | Chou | D21/234 |
| 3,210,111 | * | 10/1965 | Fallon . | |
| 3,349,422 | * | 10/1967 | Heil . | |
| 4,960,278 | * | 10/1990 | Hainey . | |
| 4,971,126 | | 11/1990 | Borenstein | 150/160 |
| 5,215,136 | | 6/1993 | Flanders et al. | 150/160 |
| 5,226,647 | * | 7/1993 | Notarmuzi . | |
| 5,690,559 | * | 11/1997 | Julius | 473/286 |
| 5,759,111 | | 6/1998 | Clark | 473/285 |
| 6,033,322 | * | 3/2000 | England | 473/408 |

OTHER PUBLICATIONS

Golfmarket. Golf Magazine, Jul. 1997: p. 174.

Holiday Gift Guide. Golf Magazine, Nov. 1997: p. 157.

Golfmarket. Golf Magazine, Jun. 1996: p. 202.

* cited by examiner

*Primary Examiner*—Jeanette Chapman
*Assistant Examiner*—Stephen L. Blau
(74) *Attorney, Agent, or Firm*—Dimock Stratton Clarizio; Mark B. Eisen

(57) ABSTRACT

A device for protecting a putter head and repairing ball marks includes a body having a protective face for abutting a face of the putter head, at least one prong extending from the body for repairing ball marks and a detachable affixing member for detachably securing the device to the putter head to protect the putter face. In one preferred embodiment a rear face of the body is provided with an absorbent pad for cleaning a golf ball.

30 Claims, 5 Drawing Sheets

MULTI-PURPOSE GOLF ACCESSORY

This application is a continuation of U.S. application Ser. No. 09/116,990, filed Jul. 17, 1998, Now U.S. Pat. No. 5,997,411.

FIELD OF INVENTION

This invention relates to golf accessories. In particular, this invention relates to a multi-purpose device which in the preferred embodiment serves as a putter face protector, a ball mark repair tool and a golf ball cleaner.

BACKGROUND OF THE INVENTION

Golf is one of the most popular sports in the world. It appeals to many because it is played in a restful atmosphere and provides a healthy activity that is not rigorous or conducive to athletic injuries as are many other sports. As such, numerous golf courses can be found in virtually all industrialized countries.

A golf course occupies a large area of land, in typically providing at least one full course of 18 "holes". Each hole consists of a tee from which golfers start play on the hole, a "fairway" along which the grass has been cut to provide a fair lie for the golf ball and which may include natural or artificial hazards such as sand traps and/or water hazards, and a "putting green" which consists of a patch of finely cut grass surrounding a cup, which according to the objects of golf is the target into which the golfer tries to place the ball using as few strokes as possible.

Golf has evolved rigid rules and standards, and golf courses tend to be carefully maintained in accordance with those rules and standards. Fairways are kept evenly trimmed and hazards are kept well defined. However, much of the effort and expense of maintaining a golf course is spent on the putting greens in particular, which must be finely trimmed and maintained in meticulous condition.

The putting greens are distinct from the rest of the golf course in other respects, being the one area of the golf course at which a golfer is permitted to pick up his or her golf ball for cleaning and the only part of the hole on which the golfer uses a putter. These features and the fine cut of the grass on the putting green are intended to reduce as much as possible obstacles to putting the golf ball into the cup, so that the golfer's so-called "short game" is almost entirely reliant upon the skill of the golfer and is relatively uninfluenced by extraneous factors such as uneven ground or other obstacles.

The putter itself is specially designed to provide maximum control, and the striking surface or "putter face" of the putter must be maintained unmarred for maximum performance. The newer generations of putter heads tend to be made from softer materials such as plastics, an/or include soft inserts such as the "Stronomic" (Trademark) insert manufactured by Odyssey, which are easily scratched and marred. This problem is exacerbated by the manner in which the putter is transported about a golf course, in a bag with many other golf clubs many of which have metal club heads. Conventional soft or flexible club head protectors are generally sufficient to properly protect the putter head as a whole, but do not provide extra protection for the putter face and are often awkward to use.

A certain degree of deterioration of the golf course results from the play of successive rounds of golf, as golfers dig divots out of the fairways with their golf clubs and leave ball marks on the finely trimmed putting greens where golf balls land and bounce to a rest position. With a view to maintaining the golf course in good condition, golfers are expected to replace their divots and to repair ball marks left on a putting green. The putting green in particular, being a relatively confined space that experiences a high concentration of activity, is especially difficult to maintain during a busy golf day. Thus, the continuing repair of ball marks is very important to the enjoyment of the game of golf by successive golfers over the course of a day.

However, the proper repair of ball marks on a putting green requires a special tool that will not damage the underlying ground or remove grass, and golfers frequently find themselves on the green without such a tool immediately available. Golf is a game that requires intense concentration, and frequently golfers are too involved in the game, particularly at the putting green, to remember either to repair their ball marks or to bring or use a tool suitable for properly repairing ball marks to the putting green (particularly given that the ball mark is usually located some distance from where the golf ball actually comes to rest on the putting green). Any ball mark repair tool must be compact and convenient to use, and must not interfere with the normal routines of the golfer or the other equipment used by the golfer during a game of golf, or the golfer will not use it. For example, a ball mark repair tool may be carried in a golfer's golf bag or pocket, but is easily forgotten because it is out of sight when the ball mark must be repaired. Golfers tend to carry a damp towel in their golf bag for cleaning the golf ball on the putting green, but this is generally inconvenient since the golf bag is not brought onto the putting green and is therefore not immediately accessible when the golfer needs to clean his or her ball.

It would accordingly be advantageous to provide a compact tool which can be used by a golfer on the putting green to repair ball marks, which is immediately accessible to the golfer but does not interfere with the play or equipment used by the golfer. It would further be advantageous for such a device to include a protector to protect the putter face of a putter head, which would ensure that the ball mark repair tool is immediately accessible to a golfer on the putting green. It would further be advantageous for such a device to include means for cleaning the golfer's golf ball.

The present invention provides a device which clips to a putter head to protect the face of the putter head, and which comprises a tool for repairing ball marks on the putting green. Since the one item that a golfer always brings to the putting green is his or her putter the ball mark repair tool is always immediately available to the golfer on the putting green when a ball mark must be repaired, and removal of the device from the putter head serves as a reminder to the golfer to repair his or her ball marks. In the preferred embodiment the device includes an absorbent pad for cleaning the golf ball.

The present invention thus provides a device for protecting a putter face of a head of a putter, comprising a body having a height approximating a height of a putter head or greater, the body including a protective face for abutting a face of a putter head, at least one prong, a length of the prong extending from the body in a direction generally parallel to a length of the putter head, and a detachable affixing member adapted to affix the device to the putter head, wherein when the device is affixed to the putter head the protective face abuts a face of the putter head to protect the face, and when the device is detached from a putter head the body may be used as a handle so that a user may use the at least one prong to repair a ball mark.

The present invention further provides device for protecting a putter face of a head of a putter, comprising a body having a height approximating a height of a putter head or greater, the body including a protective face for abutting a face of a putter head, at least one prong extending from the body in a direction generally parallel to the protective face, a length of the body and the prong together overlying a length of a putter head, and a detachable affixing member adapted to affix the device to the putter head, wherein when the device is affixed to a putter head the protective face abuts a face of the putter head to protect the face of the putter head, and when the device is detached from the putter head the body may be used as a handle so that a user may use the at least one prong to repair a ball mark.

A device for protecting a putter face of a head of a putter, comprising a body having a height approximating a height of a putter head or greater, the body including a protective face for abutting a face of a putter head, at least one prong extending from the body to overlie the putter face, and a member for detachably affixing the device to the putter head, wherein when the device is affixed to a putter head the protective face abuts a face of the putter head to protect the face, and when the device is detached from a putter head the body may be used as a handle so that a user may use the at least one prong to repair a ball mark.

BRIEF DESCRIPTION OF THE DRAWINGS

In drawings which illustrate by way of example only a preferred embodiment of the invention.

DETAILED DESCRIPTION OF THE INVENTION

Figure 1:
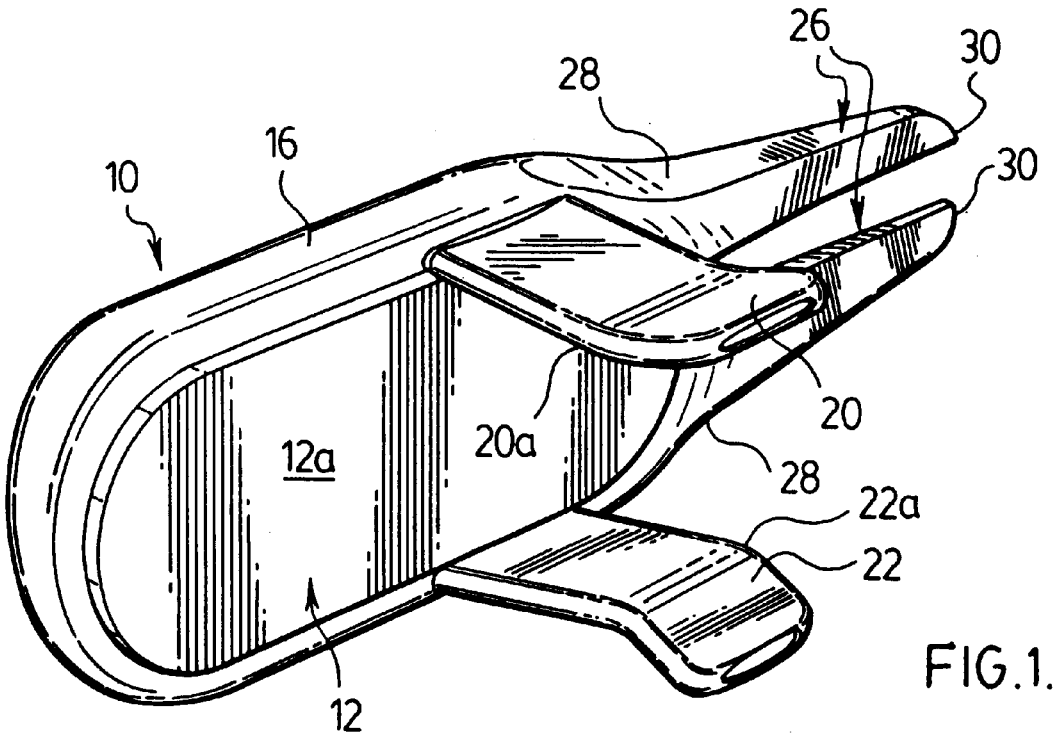
FIG. 1 is a rear perspective view of a device embodying the invention.
Figure 2:
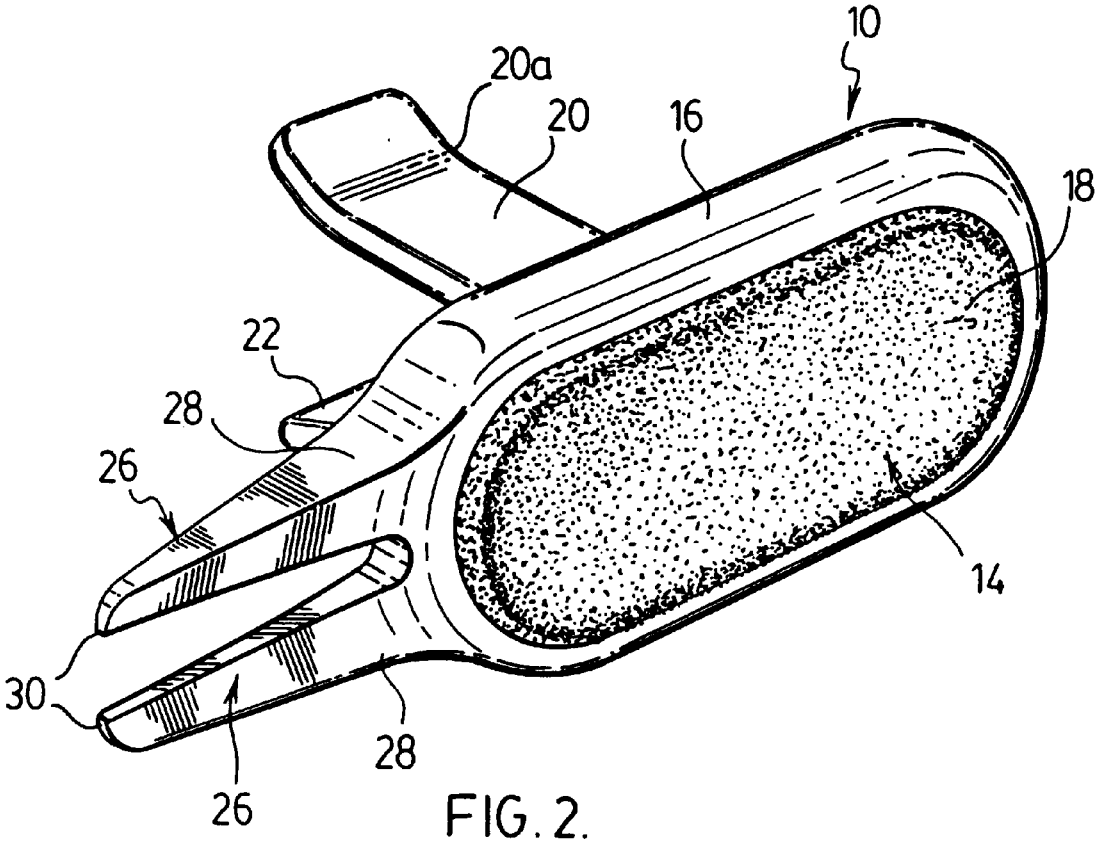
FIG. 2 is a front perspective view of the device of FIG. 1.
Figure 3:
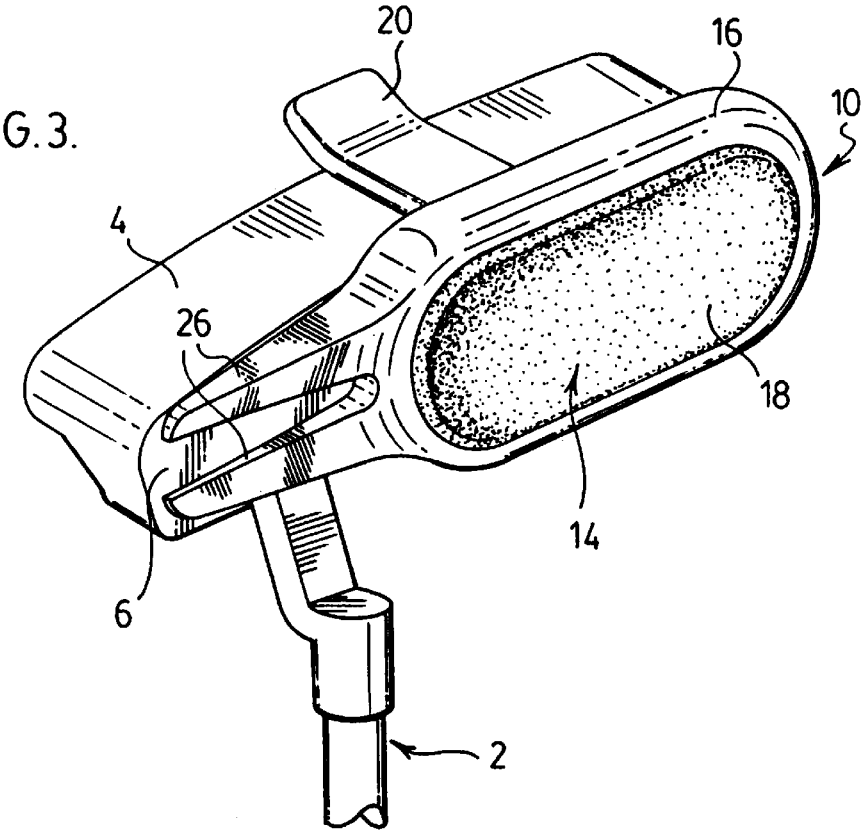
FIG. 3 is a perspective view of the device of FIG. 1 affixed to a putter head.

As illustrated in FIGS. 1 and 2, the device comprises a body 10 having a height approximating the height of a putter head 4. The body 10 protects the putter face 6 of the putter head, as shown in FIGS. 3 and 4, and also serves as a handle for the device when used to repair ball marks, as described below.

The body 10 has a protective face 12 and a front face 14, and a side edge 16, preferably rounded, extending about the body 10. The protective face 12, which abuts the face 6 of a putter head 4 when the device is used as a putter head protector, is preferably planar and smooth. However, where the face 6 of the putter head 4 is not planar the protective face 12 may be configured to conform to the face 6 of the putter head 4. The protective face 12 may include a layer of resilient foam 12*a* or the like to prevent abrasion between the body 10 and the putter face 6. The device may be affixed to the head of a putter by any suitable detachable affixing member, for example an elastic band, hook-and-loop fastener strap, spring loaded clip or the like. In the preferred embodiment shown a clip comprising a pair of arms 20, 22 projects from the protective face 12 of the device, for detachably affixing the device to a putter head 4. The arms 20, 22 are spaced apart a distance corresponding to the height of a typical putter head 4, and in the preferred embodiment each arm 20, 22 respectively comprises a slight bend 20*a*, 22*a* which facilitates securing the device to the putter head 4. The arms 20, 22 are resilient, allowing the arms 20, 22 to accommodate putter heads of different sizes and to splay apart slightly as the device is clipped onto a putter head 4, but should be sufficiently strong that the device will not become inadvertently dislodged from the putter head 4.

In the embodiment shown an orthogonal arm 20 projects from the protective face 12 at substantially a right angle and an angled arm 22 projects from the protective face 12 at an acute angle. The orthogonal arm 20 allows the device to be clipped to a putter head 4 relatively easily, without damaging or deforming the arms 20, 22, and engages a right-angled top or bottom of the putter head 4 (virtually every putter 2 has one surface, either the top or bottom of the putter head 4, disposed at a right angle to the putter face 6). The angled arm 22 retains the device snugly against the face 6 of the putter head 4, as can be seen in FIG. 5.

Figure 4:
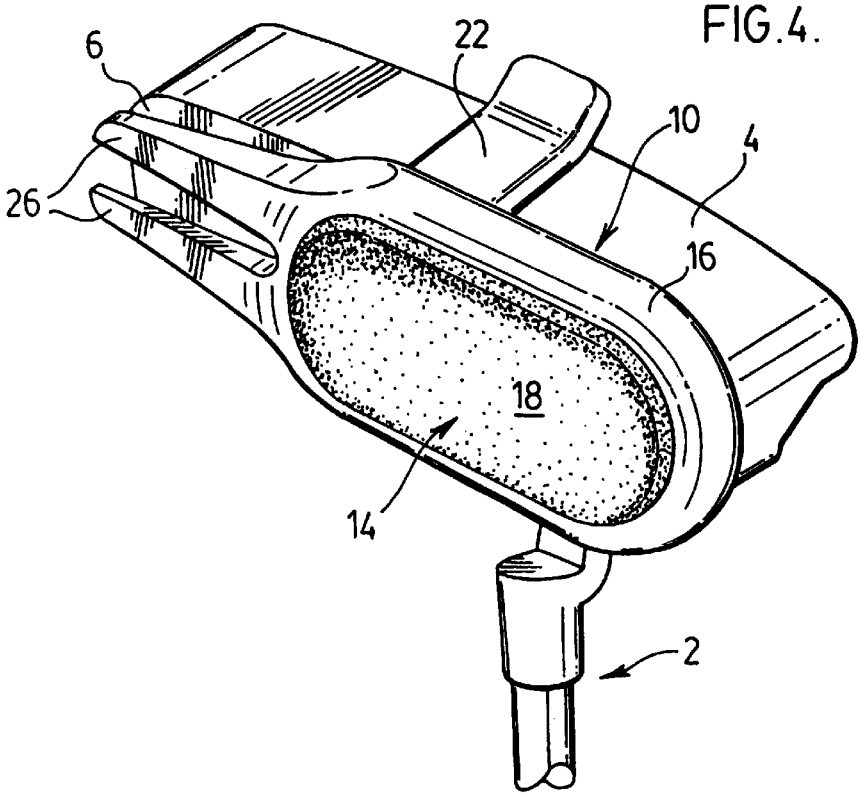
FIG. 4 is a further perspective view of the device of FIG. 1 affixed to a putter head.
Figure 5:
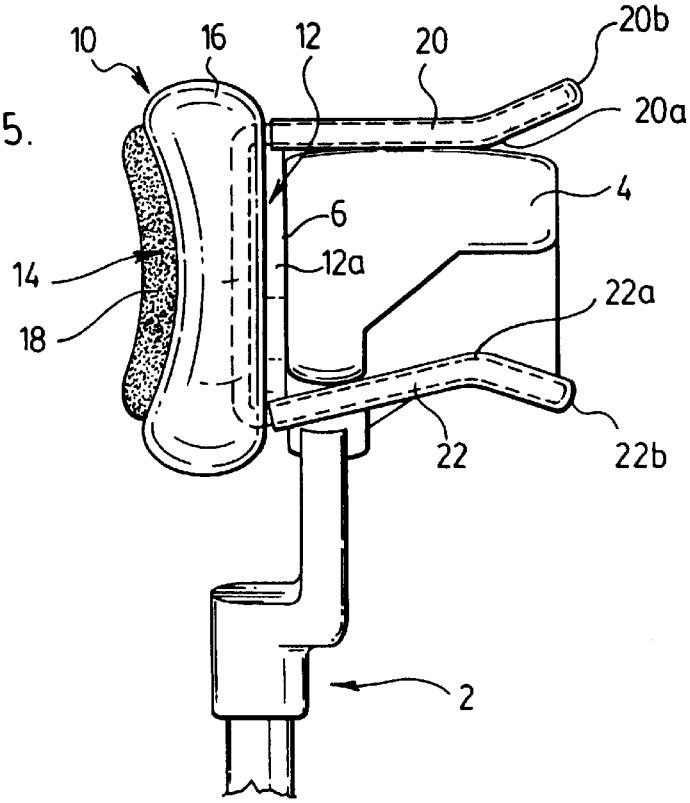
FIG. 5 is a side elevation of the device of FIG. 1 affixed to a putter head.

This unsymmetrical configuration of the arms 20, 22 allows the device to more readily adapt to putter heads of different shapes, since the device can be secured to the putter head 4 with the angled arm 22 affixed over the top of the putter head 4, as shown in FIG. 4, or with the angled arm 22 affixed over the bottom of the putter head 4, as shown in FIG. 5. However, orienting both clips orthogonally to the protective face 12 has the advantage of adapting readily to both right- and left-handed putters. The cross-sectional shape of each particular putter head 4 will determine the optimum orientation of the device when in use as a putter head protector. The arms 20, 22 may be composed of a resilient material such as plastic, or spring steel which may optionally provided with a plastic or rubber coating 20*b*, 22*b* to prevent scratching as the device is affixed to or removed from the putter head 4.

Figure 7:
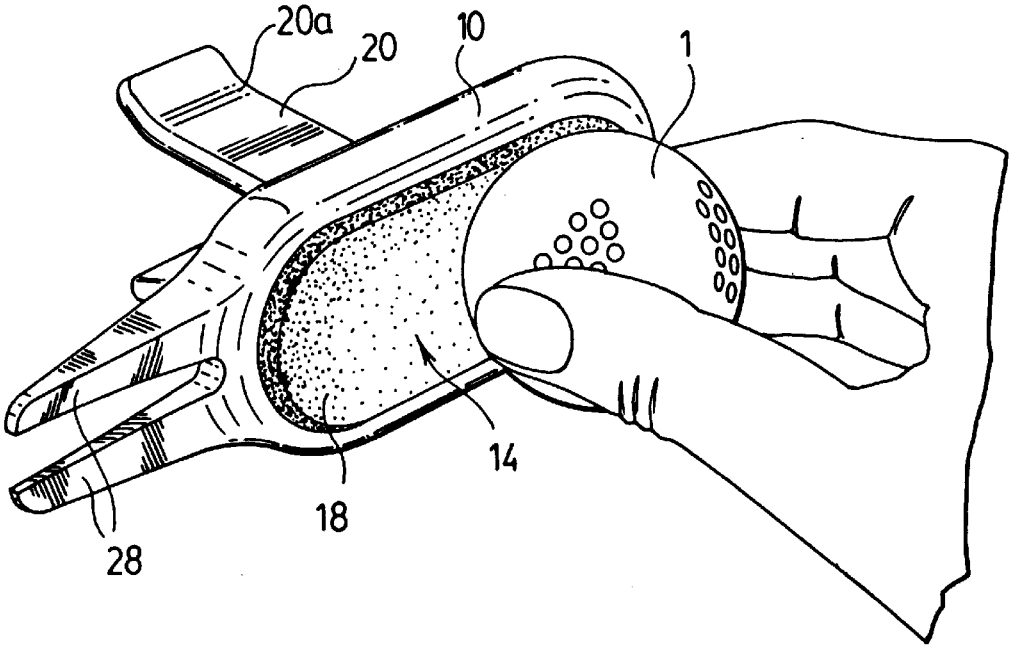
FIG. 7 is a perspective view of the device of FIG. 1 being used to clean a golf ball.

The front face 14 of the body 10 may be provided with an absorbent pad 18, which may be affixed to the front face 14 by a suitable adhesive, to provide a means for cleaning a golf ball 1. The front face 14 may thus be concave, complimentary to the shape of a golf ball 1 as can be seen in FIG. 7, to facilitate cleaning the golf ball 1. Since the putting green is the one area of a golf course where a golfer is permitted to pick up their ball and clean it, the absorbent cleaning pad 18 provides additional incentive for the golfer to bring the device onto the putting green. The absorbent pad 18 may be dampened before use, and is preferably thick enough to retain sufficient moisture to clean golf balls throughout a complete round of golf.

Figure 6:
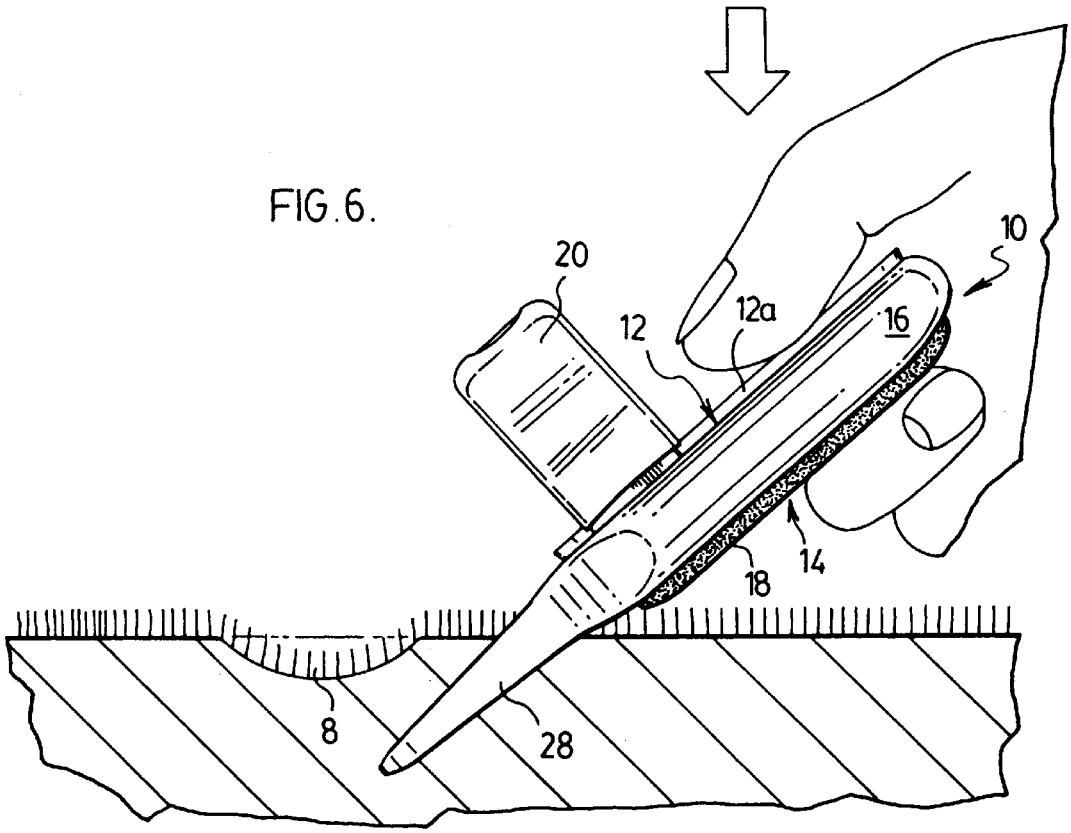
FIG. 6 is a side elevation of the device of FIG. 1 being used to repair a ball mark.

The device is provided with a ball mark repair tool comprising at least one prong projecting from the body 10. In the preferred embodiment the device is provided with a pair of prongs 26 which preferably taper gradually from a base portion 28 to tips 30, and are spaced apart to distribute a prying force. The prongs 26 are adapted to be inserted into the ground in the vicinity of a ball mark 8, as shown in FIG. 6, and the body 10 serves as a handle allowing the golfer to repair the ball mark 8 by gently raising the earth around and beneath the ball mark 8 to re-level the surface of the putting green. In one preferred embodiment the concave profile of the front face 14 continues along the front face of the prongs 26, as best seen in FIG. 2, and is also provided along the rear face of the prongs 26, which allows the device to conform to the contour of the ball mark 8 regardless whether the front or the rear of the device is oriented toward the ball mark 8.

The prongs 26 also serve to protect the putter face 6 of the putter head 4, as shown in FIGS. 3 and 4. Although the prongs 26 are spaced apart, and may also be spaced from the putter face 6 because of their gradual taper, the prongs 26 nonetheless protect the putter face 6 by deflecting any potentially marring object (such as other golf clubs in a golf bag) that might scratch or mar the putter face 6. As such the device may be made quite compact, the total length of the device (ie. body 10 plus prongs 26) being approximately the length of a typical putter head 4. The height of the device may be slightly larger than the height of the putter head, as shown, which both allows the clip to project from the rear face 12 and protects the peripheral edges of the putter head from scratching or marring contact with other golf clubs in a golf bag.

The body 10 and prongs 26 are preferably integrally formed, from any suitable material such as plastic, metal or wood which may be painted or coated for a pleasant appearance. Plastic is preferred for the body 10 because the arms 20, 22 can be formed as an integral "U"-shaped clip which is embedded in the plastic during molding, as shown in FIG. 5, to resist breakage of the arms 20, 22. Also, the device should be water resistant, so that use of the ball mark repair tool in moist ground and dampening of the absorbent pad 18 will not deteriorate the device. However, the prongs 26 may equally be formed from a suitably rigid metal and embedded in a plastic or wood body 10.

In use as a putter head protector, the device is affixed to a putter head 4 by orienting the device so that it is in alignment with the putter face 6, placing the angled arm 22 over the top or bottom of the putter head 4 (depending upon the configuration of the putter head 4) and depressing the device toward the putter head 4 until the orthogonal arm 20 snaps over the putter head 4 and the foam layer 12*a* rests against the putter face 6. The putter 2 may be safely carried in a golf bag with the device in place to protect the putter head 4.

Figure 8:
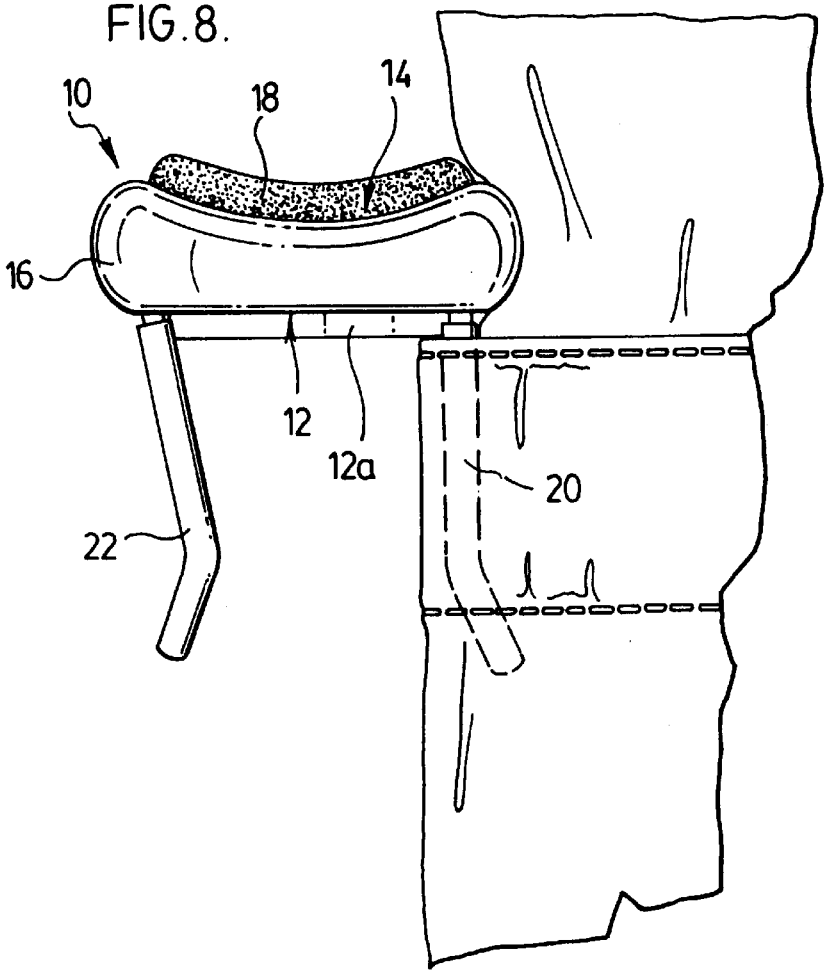
FIG. 8 is a side elevation of the device of FIG. 1 clipped to a golfer's belt for storage.

When a golfer has reached the putting green on a hole, the golfer removes the putter 2 from the golf bag. The body 10 is drawn away from the putter face 6, and the device is removed from the putter head 4. The golfer may then use the device to repair his or her ball mark 8 by repeatedly inserting the prongs 26 into the earth around the ball mark 8, gently prying the earth inward toward the centre of the ball mark 8 and optionally tapping the repaired ball mark 8 with the putter head 4 to compact the earth. The golfer may also clean his or her ball 1 using the absorbent pad 18. The device may be clipped to the golfer's pocket or belt, as shown in FIG. 8, when the device is not in use. When the golfer has putted the ball into the hole, the golfer replaces the device 10 onto the putter head 4 as described above and can stow the putter 2 in a golf bag until required for use at the next putting green.

Figure 9:
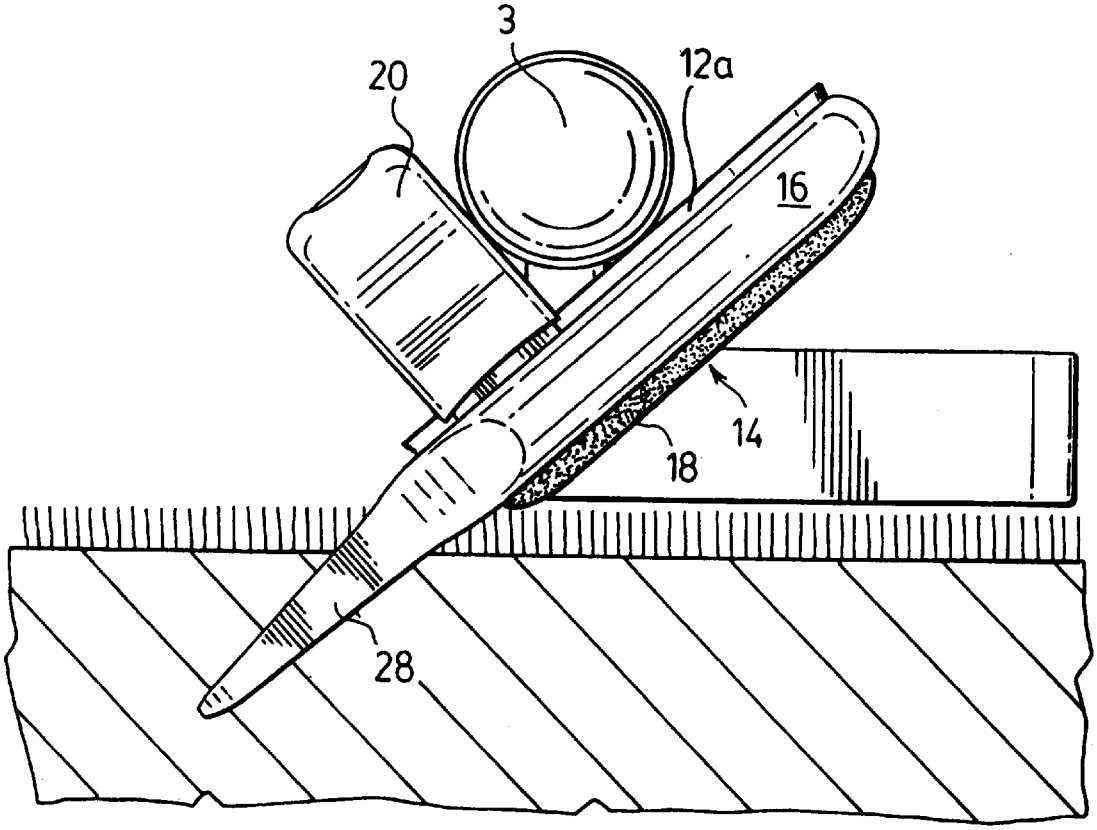
FIG. 9 is a side elevation of the device of FIG. 1 inserted into the ground to support the grip of a putter.

As an added advantage, if the golfer needs to put down the putter 2 while on the putting green, for example to analyze the "lie" of the ground and determine the optimum angle and speed of a putt, the golfer may insert the prongs 26 into the ground and use the body 10 as support for the grip 3 of the putter 2, as shown in FIG. 9, or any other club, to prevent wetting or soiling of the grip 3.

A preferred embodiment of the invention having been thus described by way of example only, it will be apparent to those skilled in the art that certain modifications and adaptations may be made without departing from the scope of the invention, as set out in the appended claims.

I claim:

1. A device for protecting a putter face of a head of a putter, comprising a body having a height approximating a height of a putter head or greater, the body including a protective face for abutting a face of a putter head, at least one prong, a length of the prong extending from the body in a direction generally parallel to a length of the putter head, and a detachable affixing member adapted to affix the device to the putter head, wherein when the device is affixed to the putter head the protective face abuts a face of the putter head to protect the face, and when the device is detached from a putter head the body may be used as a handle so that a user may use the at least one prong to repair a ball mark.

2. The device of claim 1 in which the affixing member comprises a clip having arms extending from the body substantially orthogonally.

3. The device of claim 2 in which the arms are coated with plastic.

4. The device of claim 1 in which a resilient pad is affixed to the protective face of the body to prevent scratching of a face of a putter head.

5. The device of claim 1 in which a length of the device is approximately equal to a length of a putter head.

6. The device of claim 1 in which the protective face is provided with an absorbent pad.

7. The device of claim 1 comprising two spaced apart prongs.

8. The device of claim 1 in which the prongs taper from a base portion adjacent to the body to tips of the prongs.

9. The device of claim 1 in which the protective face is generally planar.

10. The device of claim 1 in which the body and the at least one prong are integrally formed from plastic.

11. A device for protecting a putter face of a head of a putter, comprising a body having a height approximating a height of a putter head or greater, the body including a protective face for abutting a face of a putter head, at least one prong extending from the body in a direction generally parallel to the protective face, a length of the body and the prong together overlying a length of a putter head, and a detachable affixing member adapted to affix the device to the putter head, wherein when the device is affixed to a putter head the protective face abuts a face of the putter head to protect the face of the putter head, and when the device is detached from the putter head the body may be used as a handle so that a user may use the at least one prong to repair a ball mark.

12. The device of claim 11 in the affixing member comprises a clip having arms extending from the body substantially orthogonally.

13. The device of claim 12 in which the arms are coated with plastic.

14. The device of claim 11 in which a resilient pad is affixed to the protective face of the body to prevent scratching of a face of a putter head.

15. The device of claim 11 in which the protective face is provided with an absorbent pad.

16. The device of claim 11 comprising two spaced apart prongs.

17. The device of claim 16 in which a face of the prongs is concave.

18. The device of claim 16 in which the prongs taper from a base portion adjacent to the body to tips of the prongs.

19. The device of claim 11 in which the protective face is generally planar.

20. The device of claim 11 in which the body and the at least one prong are integrally formed from plastic.

21. A device for protecting a putter face of a head of a putter, comprising a body having a height approximating a height of a putter head or greater, the body including a protective face for abutting a face of a putter head, at least one prong extending from the body to overlie the putter face, and a member for detachably affixing the device to the putter head, wherein when the device is affixed to a putter head the protective face abuts a face of the putter head to protect the face, and when the device is detached from a putter head the body may be used as a handle so that a user may use the at least one prong to repair a ball mark.

22. The device of claim 21 in which the affixing member comprises a clip having arms extending from the body substantially orthogonally.

23. The device of claim 22 in which the arms are coated with plastic.

24. The device of claim 21 in which a resilient layer is affixed to the protective face of the body to prevent scratching of a face of a putter head.

25. The device of claim 21 in which a length of the device is approximately equal to a length of a putter head.

26. The device of claim 21 in which the protective face is provided with an absorbent pad.

27. The device of claim 21 comprising two spaced apart prongs.

28. The device of claim 27 in which the prongs taper from a base portion adjacent to the body to tips of the prongs.

29. The device of claim 21 in which the protective face is generally planar.

30. The device of claim 21 in which the body is formed from plastic and the at least one prong is formed from metal.

* * * * *